US007473110B1

(12) United States Patent
Wu et al.

(10) Patent No.: US 7,473,110 B1
(45) Date of Patent: Jan. 6, 2009

(54) ELECTRICAL CONNECTOR

(75) Inventors: Jian-Feng Wu, Kunshan (CN); Yong Luo, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/214,179

(22) Filed: Jun. 16, 2008

(30) Foreign Application Priority Data

Jun. 15, 2007 (CN) ..... 2007 2 0039619

(51) Int. Cl.
*H01R 12/00* (2006.01)

(52) U.S. Cl. ..... 439/79

(58) Field of Classification Search ..... 439/79, 439/872

See application file for complete search history.

(56) References Cited

U.S. PATENT DOCUMENTS

| | | | | |
|---|---|---|---|---|
| 5,007,851 | A | 4/1991 | Matsumoto | |
| 5,186,633 | A * | 2/1993 | Mosser, III | 439/79 |
| 5,240,422 | A * | 8/1993 | Kobayashi et al. | 439/78 |
| 5,725,386 | A * | 3/1998 | Davis et al. | 439/79 |
| 6,309,227 | B1 * | 10/2001 | Chen et al. | 439/79 |
| 6,811,433 | B2 * | 11/2004 | Jou | 439/541.5 |

* cited by examiner

*Primary Examiner*—Tho D Ta
(74) *Attorney, Agent, or Firm*—Wei Te Chung

(57) ABSTRACT

An electrical connector includes an insulating housing (1) with at least one terminal (2) mounted therein. The at least one terminal includes a retaining portion (21) received and retained in the insulating housing, a bending portion (23) extending from the retaining portion (21) and a solder portion (24) extending from the bending portion (23). The bending portion (23) and the solder portion (24) expose to an exterior of the housing. The bending portion (23) offsets to the retaining portion and part of a rear end of the retaining portion serves as an operating portion.

4 Claims, 4 Drawing Sheets

ELECTRICAL CONNECTOR

BACKGROUND OF THE INVENTION

1. Field of the Invention

The present invention relates to an electrical connector, and particularly to a connector which can assure an exact position of a terminal solder portion.

2. Description of the Prior Art

U.S. Pat. No. 5,007,851 discloses a power connector mounted onto a printed circuit board (PCB). As shown in FIG. 1 of said patent, a stationary contact piece 3 is provided with a board shaped plate portion 31 and a solder portion 32 extending from a rear end of the plate portion 31. As known, the rear end of the plate portion 31 is where the plate portion 31 to be pressed to be inserted into a corresponding channel defined in the housing. The solder portion 32 is bended laterally and offset to the plate portion 31 at top edge of the plate portion 31. The bending jointing portion between the solder portion 32 and the plate portion 31 is in front of the rear end of the plate portion 31, so a receiving channel of the housing should provide a large open to accommodate the bending jointing portion.

SUMMARY OF THE INVENTION

Accordingly, an object of the present invention is to provide an electrical connector which can assure an exact position of a terminal solder portion.

In order to achieve the object set forth, an electrical connector comprises an insulating housing with at least one terminal mounted therein. The at least one terminal comprises a retaining portion received and retained in the insulating housing, a bending portion extending from the retaining portion and a solder portion extending from the bending portion. The bending portion and the solder portion expose to an exterior of the housing. The bending portion offsets to the retaining portion and part of a rear end of the retaining portion serves as an operating portion.

Other objects, advantages and novel features of the invention will become more apparent from the following detailed description of the present embodiment when taken in conjunction with the accompanying drawings.

DETAILED DESCRIPTION OF THE INVENTION

Figure 1:
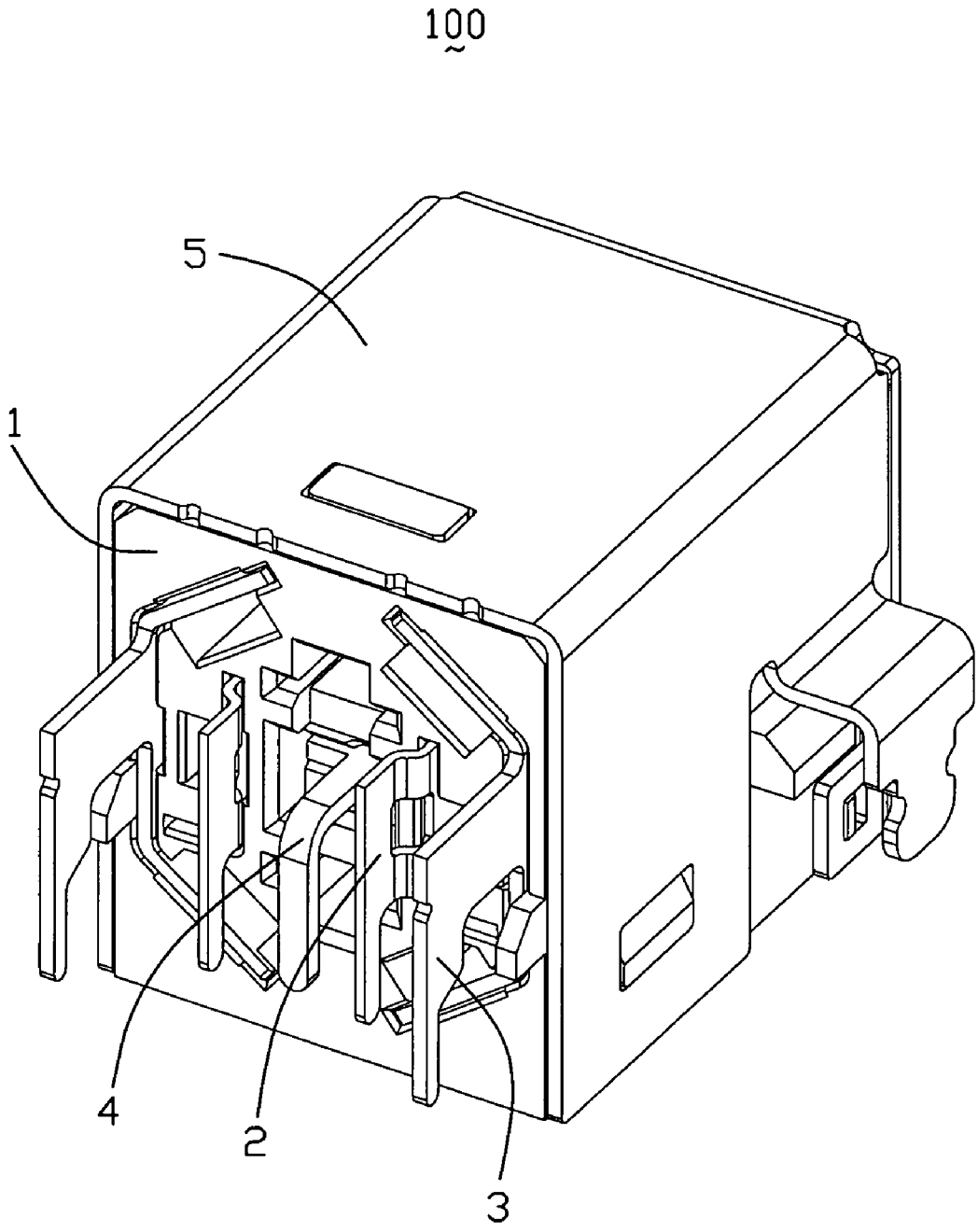
FIG. 1 is a perspective view of an electrical connector in accordance with the present invention.

Reference will now be made to the drawing figures to describe a preferred embodiment of the present invention in detail.

Referring to FIG. 1, an electrical connector 100 according to a preferred embodiment of the present invention is provided and comprises an insulating housing 1, a plurality of first and second power terminals 2, 3 and a signal terminal 4 mounted in the insulating housing 1 and a shield 5 surrounding the insulating housing 1.

Figure 2:
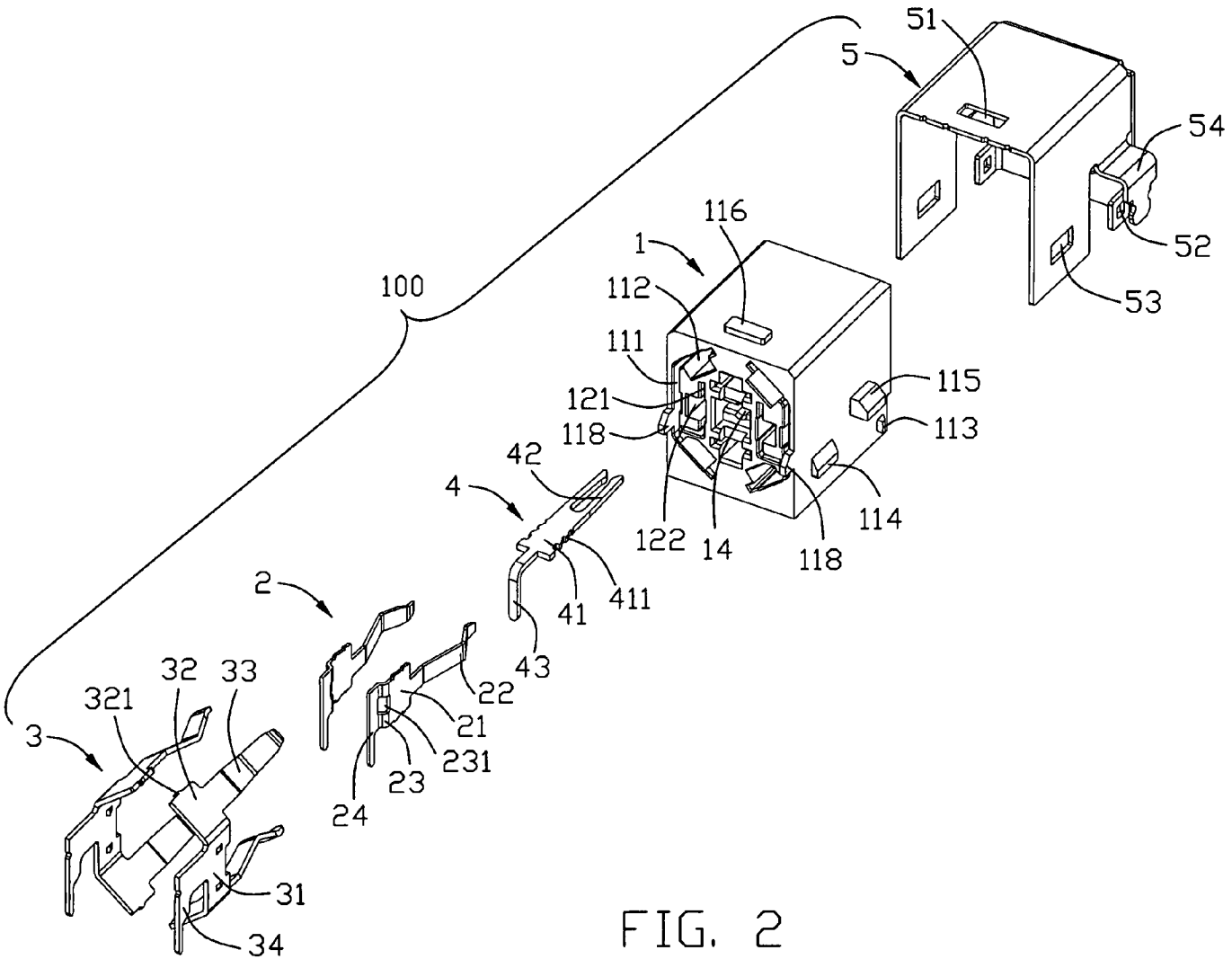
FIG. 2 is an exploded view of the electrical connector shown in FIG. 1.
Figure 3:
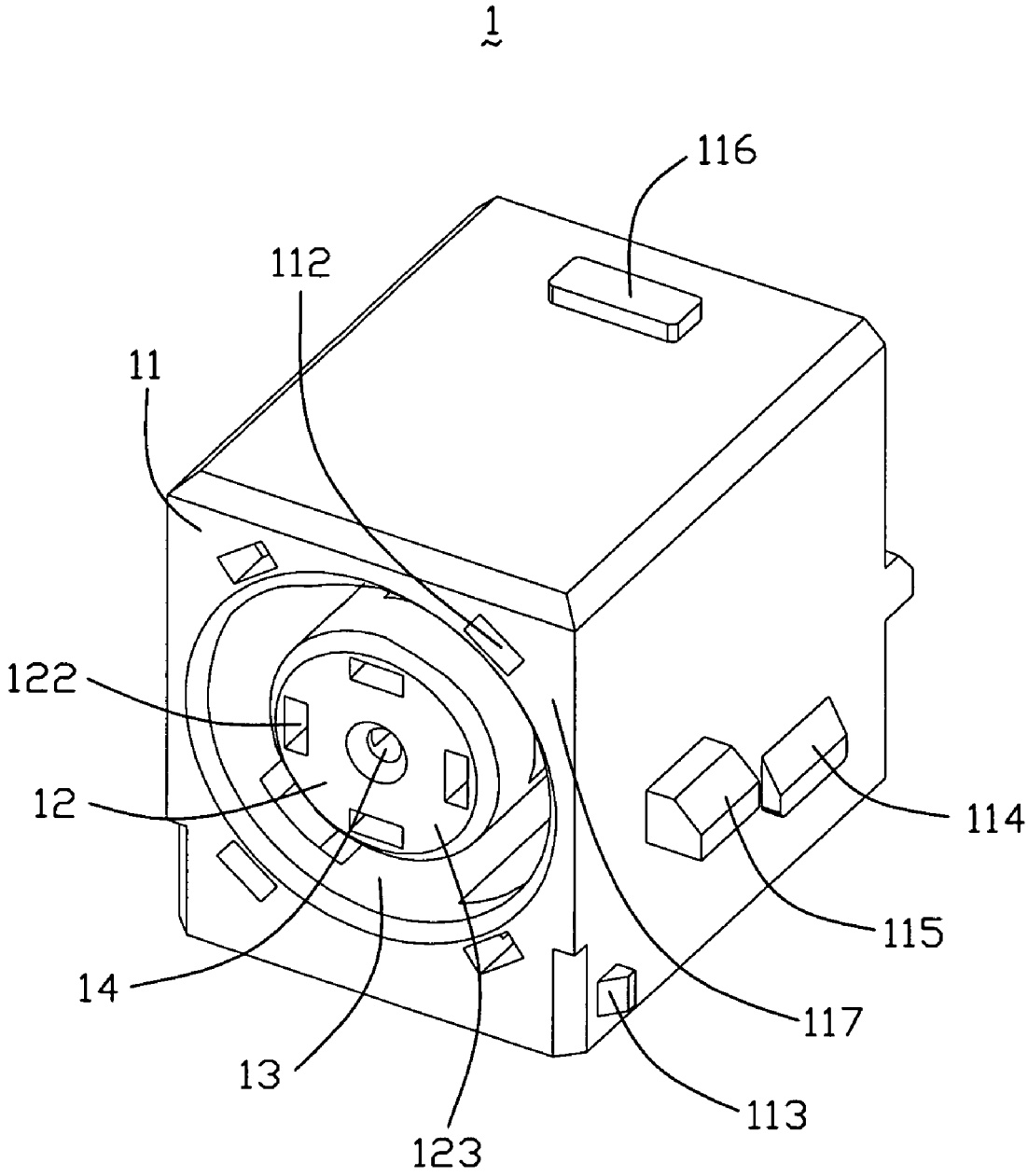
FIG. 3 is a perspective view of an insulating housing of the electrical connector.

Referring to FIG. 2, the insulating housing 1 is in a block shape and comprises a cubical first housing 11 defining a receiving space 13 therein and a cylindrical second housing 12 integrally extending forward from a rear wall of the first housing 11 and exposed to the receiving space 13. A receiving slot 14 runs through the second housing 12 along a longitudinal axis of the insulating housing 1. A hexagon first receiving groove 111 and a first receiving aperture 112 communicating with the first receiving groove 111, are defined in the rear wall of the first housing 11. The first receiving aperture 112 penetrates a front wall 117 of the first housing 11 and opens to the receiving space 13 in a middle portion thereof, as FIG. 3 shown. A second receiving groove 121 and a second receiving aperture 122, which are respectively similar to and at inner circle of the first receiving groove 111 and first receiving aperture 112, are defined in the rear wall of the second housing 12. A bottom wall (not figured) of the insulating housing 1 parallel to the PCB is defined as a mounting surface of the electrical connector. Protrusions 113, 114, 116 are respectively formed on the side wall and upper wall of the first housing 11 to lock with the shield 5 and supporting portions 115, 118 are respectively formed on the side wall and rear wall of the first housing 11 to keep the electrical connector 100 above the printed circuit board (PCB) when the connector is mounted on the PCB.

Figure 4:
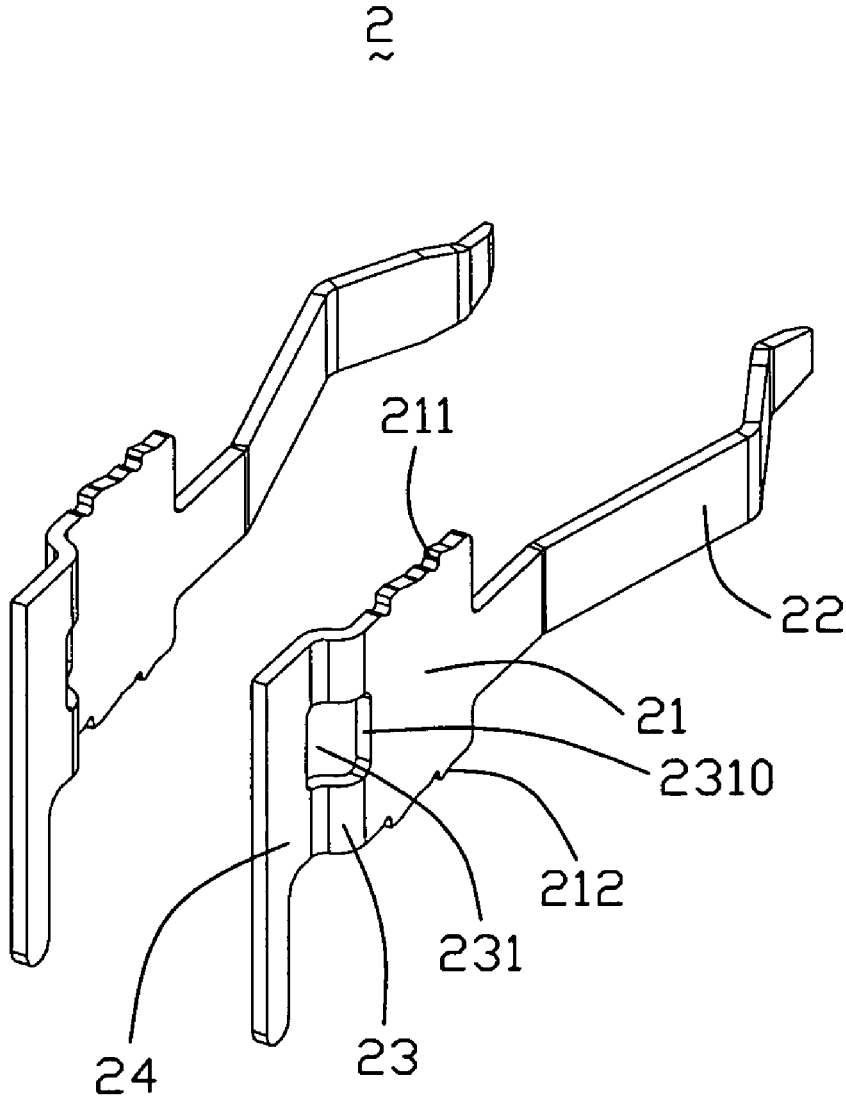
FIG. 4 is a perspective view of a first power terminal of the electrical connector.

Referring to FIGS. 2 and 4, the first power terminal 2 comprises two flat metal plates and each comprises a vertical sheet like retaining portion 21, a contacting portion 22 extending forward from the retaining portion 21, a bending portion 23 extending rearward and offsetting to the retaining portion 21 and a solder portion 24 extending rearward from the bending portion. The solder portion 24 is parallel to the retaining portion 21 and has a leg extending downward to connect with the PCB. A plurality of tips 211, 212 are formed at edges of the retaining portion 21. An opening 231 is defined in the bending portion 23, so a rear end of the retaining portion 21 is exposed to function as an operating portion 2310.

The pair of first power terminals 2 are inserted into the insulating housing 1 from the rear wall of the second housing 12. As the bending portions 23 are extending inwardly face to face, therefore the operating portion 2310 is substantially exposed outwardly and a tool can directly press on the operating portion 2310 to urge the terminal 2 into the housing 1. The retaining portion 21 is received in the second receiving groove 121 with tips 211, 212 interfering with the second receiving groove 121 and the contacting portion 22 is received in the second receiving aperture 122 and partly projects to the receiving space 13. The bending portion 23 and the solder portion 24 expose to the outer of the insulating housing 1.

Referring to FIG. 2, the pair of second power terminals are in a ring shaped. Each second power terminal 3 comprises a body portion 31, a pair of retaining portions 32 extending inwardly from opposite ends of the body portion 31 with a plurality of tips 321 thereon, a contacting portion 33 extending forwardly from an edge of the retaining portion 32 and a solder portion 34 extending downwardly from the body portion 31. The body portion 31 and the retaining portion 32 are received in the first receiving slot 111 and the contacting portion 33 is received in the first receiving aperture 112 and partly exposes in the receiving space 13.

The signal terminal 4 received in the receiving slot 14 comprises a horizontal base portion 41, a fork shaped mating portion 42 and a solder portion 43 extending downwardly perpendicular to the base portion 41. The shield 5 covers the insulating housing 1 and defines a plurality of openings

51,52,53 to interlock with the protrusions 113,114,116 and a solder portion 54 to be mounted onto the PCB.

In the present invention, the electrical connector is mounted onto the PCB in a perpendicular direction and the solder portions 24 of the first power terminals 2 are vertical to the PCB to be mounted on the pre-positioned conductive pads. As the solder portion 24 and the retaining portion 21 offset to each other by the bending portion 23 therebetween, when a distance between the conductive pads is changed due to a different need, the bending portions 23 can be bend to adjust the deviation thereby assuring the solder portions 24 to be exactly mounted on the conductive pads. Moreover, rear end of the retaining portion 23 severs as an operating portion 2310 when the first power terminals 2 are assembled, which can avoid directly push of the operating tool on the solder portion 24 so as to avoid deflection of the solder portion 24, i.e. it can assure an exact position of the solder portion 24 of the first power terminal. Further, the bending portions 23 of the first power terminals 2 are bend inwardly and the operating portions are exposed outwardly, which is convenient for the tool to press the first power terminals 3 into the housing.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulating housing with at least one terminal mounted therein;

said at least one terminal comprising a retaining portion received and retained in the insulating housing, a bending portion extending from the retaining portion and a solder portion extending from the bending portion, the bending portion and the solder portion exposing to an exterior of the housing;

a ring shaped second terminal, the second terminal being retained in the housing and surrounding the at least one terminal;

wherein the bending portion offsets to the retaining portion and part of a rear end of the retaining portion serves as an operating portion;

wherein an opening is defined on the bending portion and said operating portion forms one side of the opening;

wherein the at least one terminal comprises a pair of metal sheets and the bending portions of the metal sheets are face-to-face bended.

2. The electrical connector as described in claim 1, wherein the solder portion is parallel to the retaining portion and has a leg extending downwardly.

3. The electrical connector as described in claim 1, wherein the housing defines a mounting surface and the solder portion of the at least one terminal is perpendicular to the mounting surface.

4. An electrical connector comprising:

an insulative housing defining a mating cavity;

a plurality of passageways extending from a rear face of the housing into the housing and communicating with the mating cavity;

a plurality of contacts assembled to the corresponding passageways from said rear face, respectively, each of said contacts including a contacting section extending into the mating cavity, a tail section for mounting to a printed circuit board, and a retention section located between the contacting section and the tail section, wherein the retention section is laterally offset from the tail section with a bending transition section which functions as a tool operation area during assembling the contact into the corresponding passageway;

wherein said bending section defines an opening so as to restrict relative movement between an assembling tool and the bending transition section;

wherein the retention section extends in a vertical plane, and the tail section extending in a vertical direction.

* * * * *